US005414327A

United States Patent [19]

Reijnaerts

[11] Patent Number: 5,414,327

[45] Date of Patent: May 9, 1995

[54] HIGH FREQUENCY DISCHARGE LAMP OPERATING CIRCUIT WITH FREQUENCY CONTROL OF THE IGNITION VOLTAGE

[75] Inventor: Jozef H. Reijnaerts, Eindhoven, Netherlands

[73] Assignee: U.S. Philips Corporation, New York, N.Y.

[21] Appl. No.: 79,299

[22] Filed: Jun. 17, 1993

[30] Foreign Application Priority Data

Jul. 20, 1992 [EP] European Pat. Off. ..... 92202205

[51] Int. Cl.[6] ..... H05B 37/02

[52] U.S. Cl. ..... 315/219; 315/209 R; 315/224; 315/244; 315/307; 315/DIG. 7

[58] Field of Search ..... 315/209 R, DIG. 5, DIG. 7, 315/224, 225, 291, 307, 284, 219, 311, 244

[56] References Cited

U.S. PATENT DOCUMENTS

| | | | |
|---|---|---|---|
| 4,501,994 | 2/1985 | Spreadbury | 315/307 |
| 4,525,648 | 6/1985 | Bijl | 315/224 |
| 4,791,338 | 12/1988 | Dean et al. | 315/174 |
| 5,142,201 | 8/1992 | Wessels | 315/209 |
| 5,172,033 | 12/1992 | Smits | 315/224 |

FOREIGN PATENT DOCUMENTS

| | | | |
|---|---|---|---|
| 4-141966 | 5/1992 | Japan | 315/219 |

*Primary Examiner*—Robert J. Pascal
*Assistant Examiner*—Arnold Kinkead
*Attorney, Agent, or Firm*—Edward Blocker; Bernard Franzblau

[57] ABSTRACT

A circuit for igniting and operating a discharge lamp includes a DC-AC converter provided with a first branch coupled to a DC voltage source and including at least one switching element for generating an alternating current at a frequency f. A load branch is coupled to the first branch A and includes inductive means (L), capacitive means, and an inductor for coupling the lamp to the load branch. A control circuit switches the switching element at the frequency f and includes a resonant circuit of a further inductor and a further capacitor. An ignition voltage limiter includes a second branch coupled to the resonant circuit and comprising a series arrangement of a frequency-dependent impedance and a semiconductor element of varible impedance as a function of its control electrodes potential at its control. A third branch is coupled to the load branch and to the control electrode of the semiconductor element for influencing the potential of the control electrode dependent upon the lamp voltage. The voltages and currents in the circuit are thereby limited during lamp ignition.

8 Claims, 1 Drawing Sheet

HIGH FREQUENCY DISCHARGE LAMP OPERATING CIRCUIT WITH FREQUENCY CONTROL OF THE IGNITION VOLTAGE

BACKGROUND OF THE INVENTION

This invention relates to a circuit arrangement for igniting and operating a discharge lamp, which arrangement comprises a DC-AC converter provided with

- a branch A provided with terminals suitable for connection to a DC voltage source and comprising at least one switching element for generating a current with alternating polarity by being conducting and non-conducting at a frequency f,
- a load branch B comprising inductive means, capacitive means, and means for coupling the discharge lamp to the load branch B, and
- a control circuit for rendering the switching element conducting and non-conducting at the frequency f and comprising a resonant circuit which comprises further inductive means and further capacitive means.

Such a circuit arrangement is known from European Patent Application 442572A1 which corresponds to U.S. Pat. No. 5,142,201 (Aug. 25, 1992). The known circuit arrangement is in particular designed for electrodeless low-pressure mercury discharge lamps and is so dimensioned that the operating frequency f of the circuit arrangement lies above the resonance frequency of the load branch both during stationary lamp operation and during ignition of the discharge lamp in order to limit power dissipation in the switching element. Ignition of the discharge lamp and stable lamp operation often take place at a substantially constant value of the frequency f. The amplitudes of the voltages and currents present in the circuit arrangement during ignition of the discharge lamp are often considerably higher than during stable lamp operation. Since these comparatively high voltages and currents can strongly reduce the life of the circuit arrangement, especially if the lamp does not (immediately) ignite as a result of, for example, ambient factors, it is desirable to provide the switching arrangement with means which prevent the amplitudes of the voltages and currents in the circuit arrangement reaching excessive values. These means may, for example, comprise voltage-limiting elements coupled to the load branch which become current-conducting when the amplitudes of the voltages and currents in the circuit arrangement assume excessive values, thus reducing the resonance frequency of the load branch. Since the operating frequency f remains substantially unchanged, the difference between the operating frequency and the resonance frequency of the load branch increases, so that the amplitudes of voltages and currents in the circuit arrangement decrease. It was found, however, that these voltage-limiting elements must comply with particularly high requirements, as a result of which they must be assembled from comparatively expensive components and nevertheless have comparatively short lives.

SUMMARY OF THE INVENTION

The invention has for its object, inter alia, to provide a circuit arrangement in which the amplitudes of the voltages and currents in the circuit arrangement during ignition of the discharge lamp do not reach excessive values, while the circuit arrangement also has a comparatively long operating life, and comparratively inexpensive components can be used.

According to the invention, this object is achieved in that the control circuit of a circuit arrangement of the kind mentioned in the opening paragraph is in addition provided with means for limiting the ignition voltage, which means comprise

- a branch C coupled to the resonant circuit and comprising a series arrangement of a frequency-dependent impedance and a semiconductor element provided with a control electrode for influencing the impedance of the semiconductor element dependent upon a potential at the control electrode, and
- a branch D coupled to the load branch and to the control electrode of the semiconductor element for influencing the potential of the control electrode in dependence on the voltage across the discharge lamp.

If the amplitude of the voltage across the discharge lamp, and coupled thereto the amplitudes of voltages and currents in the circuit arrangement reach an excessively high value during the ignition of the discharge lamp, the potential of the control electrode of the semiconductor element is brought to such a value by means of the branch D that the impedance of the semiconductor element decreases. Owing to this decrease in the impedance of the semiconductor element, the branch C will carry a greater fraction of the current flowing in the control circuit. As a result of this, the frequency f with which the control circuit oscillates is also determined to an increasing extent by the frequency-dependent impedance of the branch C, with the result that the frequency f increases. This increase in the frequency f causes an increase in the difference between the frequency f and the resonance frequency of the load branch, and thus also a decrease in the amplitudes of the voltages and the currents in the circuit arrangement. Since both branch C and branch D form a part of the control circuit, these branches may be composed of components which are designed for only a comparatively low power. Both the cost price and the operating life of the circuit benefit from this.

It is noted that European Patent 93469 which corresponds to U.S. Pat. No.4,525,648 (Jun. 25, 1985), describes a circuit arrangement for operating a discharge lamp in which provisions also are made for increasing the operating frequency of the circuit arrangement if the voltages in the circuit arrangement reach excessive values during the ignition of the discharge lamp. The circuit arrangement described in the said document also comprises switching elements for generating a current of alternating polarity and a control circuit for rendering the switching elements conducting and non-conducting. The provisions for limiting the ignition voltage provided in the control circuit of the circuit arrangement, however, contain components which dissipate a comparatively large portion of the power of the control signal. This comparatively high power dissipation adversely affects the speed with which the switching elements become conducting and non-conducting. This decrease in the switching speed may cause a comparatively high power dissipation in the switching elements, especially when the operating frequency of the circuit arrangement at which the discharge lamp is ignited is comparatively high, which may also lead to damage of the switching elements. This comparatively high power dissipation in the switching elements renders the circuit arrangement described in European Patent 93469 unsuitable for applications in which a discharge lamp operated by means of the circuit arrangement is ignited at a comparatively high operating frequency.

An advantageous embodiment of a circuit arrangement according to the invention is characterized in that the semiconductor element is constructed as a transistor. The impedance of a transistor can be adjusted comparatively quickly by means of the potential applied to the base of the transistor. The impedance of the transistor in the conducting state is also comparatively small so that the power dissipated in the branch C is only relatively small. These two properties of a transistor are especially advantageous when the operating frequency f is comparatively high, as is the case, for example, in a circuit arrangement for operating an electrodeless low-pressure mercury discharge lamp.

A further advantageous embodiment of a circuit arrangement according to the invention is characterized in that the frequency-dependent impedance comprises inductive means. It was found that the amplitudes of currents and voltages in this further advantageous embodiment of the circuit arrangement are effectively limited during ignition of the discharge lamp, while the circuit arrangement remains in a stable operating state during this limiting action.

Another advantageous embodiment of a circuit arrangement according to the invention is characterized in that the circuit arrangement is in addition provided with a timer circuit for rendering the potential to which the amplitude of the ignition voltage is limited dependent on time. By causing the value to which the ignition voltage, and thus the other voltages in the circuit arrangement are limited to increase gradually during ignition of the discharge lamp, it is achieved that the discharge lamp is ignited at a comparatively low ignition voltage, by which in general the operating life of both the circuit arrangement and the discharge lamp is favourably affected.

A particularly advantageous embodiment of a circuit arrangement according to the invention is characterized in that the circuit arrangement is also provided with dimming means for the substantially square-wave modulation of the alternating-polarity current, and is provided with a second timer circuit for triggering the dimming means when a fixed time interval has elapsed after lamp ignition. When the duty cycle of the square-wave modulation is adjustable, it is possible to adjust the luminous flux of the discharge lamp with the dimming means. During ignition of the discharge lamp, however, the dimming means without further measures would cause the ignition voltage to be absent across the discharge lamp during a portion of each square-wave period, which hampers the ignition of the discharge lamp, the more so since the amplitude of the ignition voltage is limited. Since the dimming means are not activated until after the lamp has ignited and has burned at maximum power during a fixed time interval in the particularly advantageous embodiment of a circuit arrangement according to the invention, a discharge lamp operated by means of this further advantageous embodiment of a circuit arrangement according to the invention exhibits a good ignition behaviour and also a good take-over behaviour in spite of the presence of the dimming means. The term "take-over" is here understood to mean the creation of a stable discharge in the plasma of the discharge lamp after ignition.

BRIEF DESCRIPTION OF THE DRAWINGS

The invention will be explained in more detail with reference to a drawing of an embodiment.

In the drawing.

DESCRIPTION OF THE PREFERRED EMBODIMENTS

Figure 1:
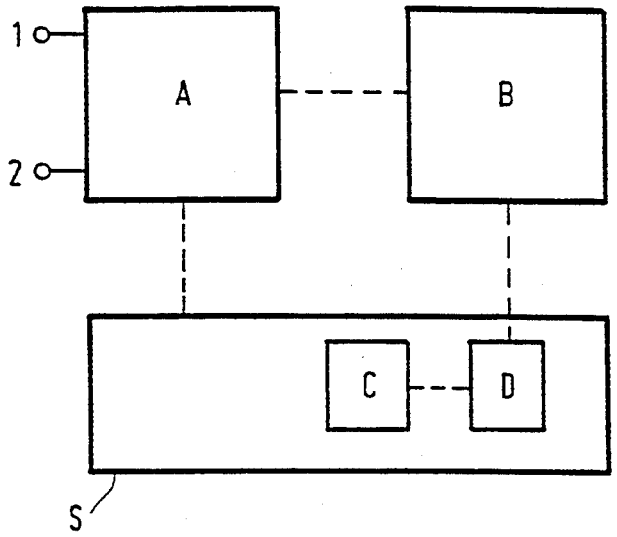
FIG. 1 is a block diagram of an embodiment of the accompanying circuit arrangement according to the invention.

In FIG. 1, reference numerals 1 and 2 denote a first terminal of branch A and a further terminal of branch A. Terminals 1 and 2 are suitable for connection to poles of a DC voltage source. Branch A comprises two switching elements for generating a current of alternating polarity in that they are alternately conducting and non-conducting at a frequency f. Branch B is a load branch which comprises inductive means, capacitive means, and means for coupling a discharge lamp to the load branch B. Load branch B is coupled to branch A. Box S is a control circuit for rendering the switching elements conducting and non-conducting at the frequency f. The control circuit S comprises for this purpose a resonant circuit comprising inductive means and capacitive means, and is for this purpose coupled to branch A. Control circuit S in addition comprises a branch C coupled to the resonant circuit and comprising a series arrangement of a frequency-dependent impedance and a semiconductor element provided with a control electrode for influencing the impedance of the semiconductor element in dependence on the potential of the control electrode. The control circuit S also comprises a branch D coupled to the control electrode of the semiconductor element and to the load branch for influencing the potential of the control electrode in dependence on the voltage across the discharge lamp.

Figure 2:
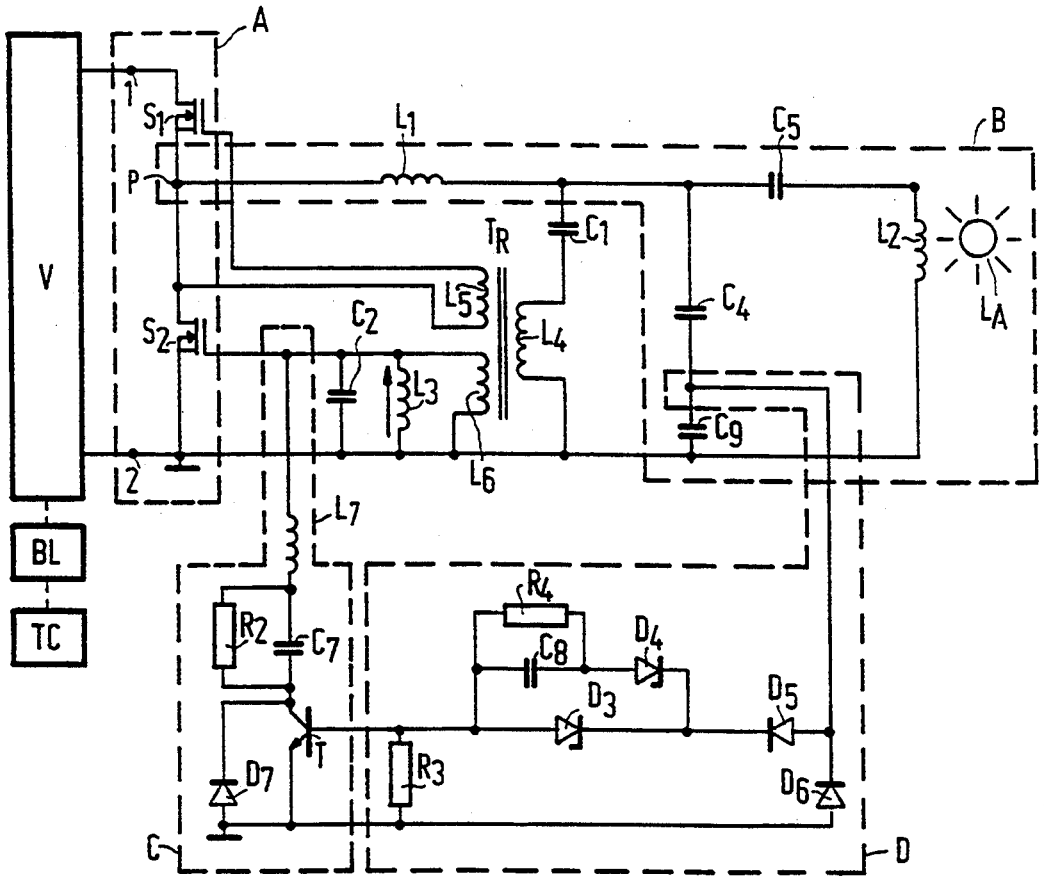
FIG. 2 shows the embodiment of FIG. 1 in more detail.

In FIG. 2, V is a DC voltage source. BL denotes dimming means for the square-wave modulation of the lamp current with an alternating polarity during stable lamp operation by means of the square-wave modulation of a DC voltage supplied by the DC voltage source V. BL is for this purpose coupled to the DC voltage source V. A timer circuit TC is provided for triggering the dimming means BL when a fixed time interval has elapsed after the ignition of a discharge lamp operated by means of the circuit arrangement. The coupling of BL to V and the coupling of TC to BL is indicated in FIG. 2 with broken lines. Terminals 1 and 2 and switching elements S1 and S2 form the branch A. Terminals 1 and 2 are connected to respective outputs of DC voltage source V. Load branch B comprises coils L1 and L2 and capacitors C4, C5 and C9. An electrodeless discharge lamp La is coupled to the load branch B by means of coil L2. Coil L1 in this embodiment forms the inductive means, capacitors C4, C5 and C9 form the capacitive means, and coil L2 forms the means for coupling the discharge lamp to the load branch B. All components present in this embodiment and not forming a part of branch A or load branch B together form the control circuit. In the control circuit, branch C is formed by coil L7, capacitor C7, resistor R2, transistor T and diode D7. Branch D is formed by diodes D5 and D6, zener diodes D3 and D4, capacitor C8 and resistors R3 and R4. Zener diodes D3 and D4, capacitor C8 and resistor R4 form a timer circuit for rendering the potential to which the amplitude of the ignition voltage is limited dependent on time.

Input terminals 1 and 2 are interconnected by a series arrangement of switching elements S1 and S2, such that a main electrode of switching element S1 is connected to terminal 1 and a main electrode of switching element S2 to terminal 2. Switching element S2 is shunted by a series circuit of coil L1, capacitor C5, and coil L2. The circuit formed by capacitor C5 and coil L2 is shunted by a series circuit of capacitor C4 and capacitor C9, and is also shunted by a series circuit of capacitor C1 and the primary winding L4 of control transformer Tr. The capacitor C1 is connected at one side to capacitor C5 and primary winding L4 is connected to coil L2 at one side. Ends of secondary winding L5 of control transformer Tr are connected to a control electrode of switching element S1 and a junction point shared by switching element S1 and switching element S2. The ends of secondary winding L6 of control transformer Tr are connected to a control electrode of switching element S2 and to terminal 2. Secondary winding L6 is shunted by coil L3 and by capacitor C2. The control electrode of switching element S2 is connected to an end of coil L7. A further end of coil L7 is connected to a first side of capacitor C7. A second side of capacitor C7 is connected to a collector of transistor T. An emitter of transistor T is connected to terminal 2 of branch A. Transistor T is shunted by diode D7 such that an anode of diode D7 is connected to the emitter of transistor T. Capacitor C7 is shunted by resistor R2. A base electrode and the emitter of transistor T are interconnected by resistor R3. The emitter of transistor T is connected to an anode of diode D6. A cathode of diode D6 is connected to an anode of diode D5. A cathode of diode D5 is connected to a cathode of zener diode D3 and an anode of zener diode D3 is connected to the base electrode of transistor T. The cathode of zener diode D3 is also connected to a cathode of zener diode D4. An anode of zener diode D4 is connected to a first side of capacitor C8. A second side of capacitor C8 is connected to the anode of zener diode D3. Capacitor C8 is shunted by resistor R4 and the cathode of diode D6 is connected to a junction point of capacitor C4 and capacitor C9.

The operation of the circuit arrangement shown in FIG. 2 is as follows.

When the terminals 1 and 2 are connected to poles of a DC voltage source, a control signal generated by the control transformer renders the switching elements S1 and S2 alternately conducting at a frequency f. A junction point P of the two switching elements is thus alternately connected to the negative pole and the positive pole of the DC voltage source. As a result, a substantially square-wave voltage is present at point P having a frequency f. This square-wave voltage causes a current to flow in the load branch, the polarity of which alternates at the frequency f. Before the lamp has ignited, this current gives rise to comparatively high voltages in the circuit arrangement. If, however, the amplitude of the voltage across capacitor C9 exceeds the zener voltage of zener diode D4, a current will flow to resistor R3 and the base-emitter junction of transistor T from capacitor C9 via diode D5, zener diode D4, and capacitor C8, so that transistor T becomes conductive. Owing to the conducting state of transistor T, a current will flow in coil L7 so that the frequency f at which the control circuit oscillates is partly determined by coil L7. Coil L7 is connected in parallel to coil L3 to a degree which is dependent on the impedance of transistor T, which leads to a reduction in the self-induction of the inductive means in the resonant circuit. As a result of this, the frequency f rises. Since the circuit arrangement is inductively operated, i.e. the frequency f lies above the resonance frequency of the load branch, an increase in the frequency f leads to a decrease in the voltages occurring in the circuit arrangement, so that these voltages are effectively limited. Capacitor C8 is charged by the current flowing from capacitor C9 to resistor R3 and the base of transistor T. In proportion as the voltage across capacitor C8 rises, the transistor T becomes conducting at a higher value of the amplitude of the voltage across capacitor C9, so that the voltages in the circuit arrangement, among them also the ignition voltage across the lamp, rise. This rise takes place until the voltage across capacitor C8 augmented by the zener voltage of zener diode D4 has become equal to the zener voltage of zener diode D3. Then the current flows from capacitor C9 through zener diode D3 to resistor R3 and the base of transistor T, and the ignition voltage and thus the other voltages and currents in the circuit arrangement are limited to a maximum value.

The timer circuit formed by zener diodes D3 and D4, resistor R4, and capacitor C8 thus ensures that the ignition voltage across the lamp rises gradually. As a result of this, the discharge lamp will ignite at a comparatively low ignition voltage, which in many cases prolongs both the life of the discharge lamp and the life of the circuit arrangement. After lamp ignition, the voltages in the circuit arrangement drop so that transistor T becomes non-conducting and the discharge lamp is operated at the stationary operating frequency. A fixed time interval after the discharge lamp has ignited, the timer circuit TC activates the dimming means BL so that the luminous flux of the discharge lamp can be adjusted to a desired value.

Resistors R2 and R4 serve to discharge capacitor C7 and capacitor C8, respectively. Capacitor C7 prevents the current in branch C from containing a DC component. When the current in branch C flows towards capacitor C2, diode D7 is conducting and transistor T carries no current. When the current in branch C flows away from capacitor C2, transistor T is conducting and diode D7 is blocked.

I claim:

1. A DC-AC converter circuit arrangement for igniting and operating a discharge lamp, comprising:

a first branch circuit including terminals for connection to a DC voltage source and comprising at least one switching element which is alternately conductive and non-conductive for generating a current with alternating polarity at a frequency f, a load branch circuit coupled to the first branch circuit and comprising inductive means, capacitive means, and means for coupling the discharge lamp to the load branch circuit, a control circuit for rendering the at least one switching element alternately conductive and non-conductive at the frequency f and comprising a resonant circuit which includes further inductive means and further capacitive means, wherein the control circuit includes means for limiting an amplitude of an ignition voltage, wherein the limiting means comprise;

a second branch circuit comprising a series arrangement of a frequency-dependent impedance and a semiconductor element having impedance, wherein the series arrangement has first and second ends thereof coupled in parallel to the resonant circuit, wherein the semiconductor element includes a control electrode for influencing the impedance of the semiconductor element dependent upon a potential at the control electrode, and a third branch circuit coupled to the load branch circuit and to the control electrode of the semiconductor element for influencing the potential of the control electrode as a function of a voltage applied to the discharge lamp.

2. A DC-AC converter circuit arrangement as claimed in claim 1, wherein the semiconductor element a comprises a transistor.

3. A DC-AC converter circuit arrangement as claimed in claim 1, wherein the frequency-dependent impedance comprises an inductive means.

4. A DC-AC converter circuit arrangement as claimed in claim 1, further comprising a timer circuit for rendering the amplitude of which the ignition voltage is limited dependent on time.

5. A DC-AC converter circuit arrangement as claimed in claim 1, further comprising dimming means for producing the substantially square-wave modulation of the alternating-polarity current, and a timer circuit for triggering the dimming means a fixed time interval after lamp ignition.

6. A DC-AC converter circuit arrangement as claimed in claim 1 wherein said third branch circuit includes means for holding said semiconductor element cut-off during a normal operation mode of the discharge lamp.

7. A DC-AC converter circuit arrangement as claimed in claim 1 wherein the third branch circuit adjusts the potential on the control electrode of the semiconductor element as a function of lamp voltage in a manner such that the second branch circuit varies a resonant frequency of the resonant circuit so as to limit the amplitude of the ignition voltage applied to the discharge lamp.

8. A DC-AC converter circuit arrangement as claimed in claim 4 wherein the discharge lamp comprises an electrodeless lamp.

* * * * *